US009714765B2

(12) United States Patent
Lewis

(10) Patent No.: US 9,714,765 B2
(45) Date of Patent: Jul. 25, 2017

(54) BURNER APPARATUS

(71) Applicant: Ian Brian Lewis, Magherafelt (GB)

(72) Inventor: Ian Brian Lewis, Magherafelt (GB)

( * ) Notice: Subject to any disclaimer, the term of this patent is extended or adjusted under 35 U.S.C. 154(b) by 311 days.

(21) Appl. No.: 14/396,612

(22) PCT Filed: Apr. 23, 2013

(86) PCT No.: PCT/EP2013/058400

§ 371 (c)(1),
(2) Date: Oct. 23, 2014

(87) PCT Pub. No.: WO2013/160306

PCT Pub. Date: Oct. 31, 2013

(65) Prior Publication Data

US 2015/0140499 A1 May 21, 2015

(30) Foreign Application Priority Data

Apr. 23, 2012 (GB) ..... 1207079.3

(51) Int. Cl.
*F23D 14/24* (2006.01)
*F23D 11/40* (2006.01)
*F23D 14/62* (2006.01)

(52) U.S. Cl.
CPC ..... *F23D 14/24* (2013.01); *F23D 11/404* (2013.01); *F23D 11/406* (2013.01); *F23D 14/62* (2013.01)

(58) Field of Classification Search
CPC ..... F23D 14/24; F23D 11/406; F23D 11/404; F23D 14/62
See application file for complete search history.

(56) References Cited

U.S. PATENT DOCUMENTS
5,573,396 A * 11/1996 Swanson ..... F23D 14/02 431/12

(Continued)

FOREIGN PATENT DOCUMENTS

CN 2533352 Y 1/2003
CN 101725985 A 6/2010

(Continued)

OTHER PUBLICATIONS
International Search Report for PCT/EP2013/058400 dated Nov. 15, 2013.

(Continued)

*Primary Examiner* — Alfred Basichas
(74) *Attorney, Agent, or Firm* — Heslin Rothenberg Farley & Mesiti P.C.

(57) ABSTRACT

The invention provides a burner configured for use with a dryer for drying aggregates, the burner comprising:

a burner chamber (3) is which is mounted a fuel-atomizing burner nozzle (3.32) and means for conveying fuel to the burner nozzle;

means providing a flow of air through the burner chamber and into the combustion chamber;

a combustion chamber (4) in which the fuel is burnt; the combustion chamber (4) having an opening at an upstream end thereof communicating with the burner chamber (3) and an opening at a downstream end thereof for passing combustion gases and heated air into a drying chamber of the dryer; the burner nozzle (3.32) being arranged to direct a flow of atomized fuel into the combustion chamber;

a first airflow modifier device (3.11) mounted in or across the opening at the upstream end of the combustion chamber such that there is a gap constituting an air escape channel around a periphery of the first airflow modifier device, the first airflow modifier device (4.3) having one or more windows therein through which a flow of air provided by the fan is directed into the combustion chamber to mix with atomized fuel from the burner nozzle, the one or more windows being configured to impart turbulence to the airflow; and (Continued)

a second airflow modifier device (4.3) comprising one or more air deflector elements (4.31) mounted peripherally about the opening at the upstream end of the combustion chamber, the second airflow modifier device (4.3) being arranged to impart turbulence to excess air passing through the said air escape channel.

20 Claims, 19 Drawing Sheets

(56) References Cited

U.S. PATENT DOCUMENTS

| | | | |
|---|---|---|---|
| 6,575,734 | B1 | 6/2003 | Brashears et al. |
| 6,652,268 | B1 | 11/2003 | Irwin et al. |
| 8,505,302 | B2 | 8/2013 | Uhm et al. |
| 2004/0219466 | A1 | 11/2004 | Marino et al. |
| 2008/0280243 | A1 | 11/2008 | Swanson et al. |

FOREIGN PATENT DOCUMENTS

| | | | |
|---|---|---|---|
| DE | 2406674 | A1 | 8/1975 |
| JP | H01203811 | A | 8/1989 |
| JP | 2000193127 | A | 7/2000 |

OTHER PUBLICATIONS

English Translation of Chinese Search Report for counterpart Chinese Application No. 2013800332161 dated Feb. 2, 2016.

* cited by examiner

BURNER APPARATUS

CROSS REFERENCE TO RELATED APPLICATIONS

This application is a national stage filing under section 371 of International Application No. PCT/EP2013/058400, filed on Apr. 23, 2013, and published in English on Oct. 31, 2013, as WO 2013/160306, and claims priority to British Application No. 1207079.3 filed on Apr. 23, 2012. The entire disclosures of each of the prior applications are hereby incorporated herein by reference.

This invention relates to a burner apparatus. More particularly, the invention relates to a burner apparatus for use in conjunction with dryers such as a rotary dryer or kiln, for example a rotary dryer of the type used for the drying of aggregates.

BACKGROUND OF THE INVENTION

Asphalt is the name used in the UK and Europe to denote the material, used in road building and other civil engineering applications, which comprises aggregates (e.g. crushed rock, gravel, shingle, sand and recycled broken up asphaltic road surface material) coated in bitumen. In the USA, this material is generally known as asphalt concrete.

The aggregates used in making asphalt typically contain substantial quantities of water, either because of the wet nature of the medium from which they have been extracted, or because they have been left out in the open and have therefore been exposed to atmospheric moisture. Consequently, the aggregates need to be dried before use. Moreover, in order to ensure efficient mixing of the aggregates and bitumen and maximise the binding of the bitumen to the aggregates, it is desirable that the aggregates should be heated prior to mixing with the bitumen. For these reasons, the aggregates used in making asphalt tend to be heated to temperatures in the range from 150 to 190° C. or higher. In some asphalt mixes such as hot rolled asphalt (HRA), temperatures as high as 220° C. to 230° C. are used.

A typical asphalt plant will therefore comprise a dryer for drying and heating the aggregates. A common form of dryer used in asphalt plants is a rotating drum dryer in which the heat for the drying process is provided by one or more combustion burners at one end of the drum. Air is drawn through the combustion burners and the heated gases from the burner pass along the interior of the rotating drum and out through a gas exhaust outlet at the far end of the drum. The stream of hot gases from the burner passing through the drum serves to dry the aggregates. In order to facilitate the drying and heating process, the internal side wall of the drying zone of the drum is provided with a series of scoops or blades which scoop up the aggregates from the floor of the drum, lift them to the high point of revolution of the drum and then drop them so that they fall back as a curtain of aggregates through the stream of hot gases to the floor of the drum. In most known types of drum dryer, a contra-flow arrangement is used in which the drum is inclined so that the drying aggregates gradually migrate from an inlet at the end of the drum opposite the combustion burner towards the end at which the burner is located. Once they have reached the burner end, the dried hot aggregates are discharged into a conveyor device, such as a bucket lift, which carries them to hot aggregate storage containers where they are stored prior to be mixed with hot bitumen to form asphalt.

A problem with many known dryers is that, for a variety of reasons, it has proved difficult to achieve efficient combustion. The short combustion zones found in many dryers and the interference caused by falling aggregates and airborne dust each contribute to inefficient combustion.

If combustion of the fuel is incomplete, the exhaust emissions vented into the atmosphere will contain large concentrations of pollutants such as carbon monoxide, sulphur and nitrogen oxides. In addition to being atmospheric pollutants, unburnt fuels will condense on the bag filters used in many aggregate drying plants shortening the useful life of the filters thereby increasing costs in replacement bags.

In order to prevent incomplete combustion, it is customary to set up a burner so that an amount of air in excess of the stoichiometric amount required for combustion is mixed with the fuel prior to or during combustion. However, if too much excess air is introduced into the burner, this will lead to inefficiency and in particular inefficient transfer of heat between the air passing through the drying drum and the aggregates in the drying drum. Ideally, therefore, a burner should be set up to use the lowest possible level of excess air needed for complete combustion.

Hitherto, it has proved very difficult to control the amount of excess air used in asphalt plant dryers and, typically, asphalt plant dryers tend to be "over-aired". Thus, whereas the gas burners used in boilers may function well using as little as 5% excess air, asphalt dryer plants typically operate with excess air levels anywhere between 100% and 1000%. As a consequence, asphalt dryer plants are typically very inefficient in terms of their energy consumption.

SUMMARY OF THE INVENTION

One object of the present invention is to provide a more energy-efficient burner-dryer arrangement which requires less excess air.

Another object of the present invention is to provide a burner in modular form in which individual modules can readily be separated or removed to give access to confined areas of the burner for maintenance purposes.

A further object of the invention is to provide a burner which is capable of burning more than one fuel efficiently.

In one aspect, the invention provides a burner for use in an aggregates dryer, the burner being provided with means for controlling the excess air.

Accordingly, in a first aspect, the invention provides a burner configured for use with a dryer for drying aggregates, the burner comprising:

- a burner chamber is which is mounted a fuel-atomising burner nozzle and means for conveying fuel to the burner nozzle;
- means providing a flow of air through the burner chamber and into the combustion chamber;
- a combustion chamber in which the fuel is burnt; the combustion chamber having an opening at an upstream end communicating with the burner chamber and an opening at a downstream end thereof for passing combustion gases and heated air into a drying chamber of the dryer; the burner nozzle being arranged to direct a flow of atomised fuel into the combustion chamber;
- a first airflow modifier device mounted in or across the opening at the upstream end of the combustion chamber such that there is a gap constituting an air escape channel around a periphery of the first airflow modifier device,
- the first airflow modifier device having one or more windows therein through which a flow of air provided by the fan is directed into the combustion chamber to mix with atomised fuel from the burner nozzle, the one or more windows being configured to impart turbulence to the airflow; and a second airflow modifier device comprising one or more air deflector elements mounted peripherally about the opening at the upstream end of the combustion chamber, the second airflow modifier device being arranged to impart turbulence to excess air passing through the said air escape channel.

Preferably, the second airflow modifier device is fixed (i.e. is immovably mounted) relative to the opening at the upstream end of the combustion chamber. For example, the second airflow modifier device can be mounted in the combustion chamber on a wall separating the combustion chamber from the burner chamber so that it surrounds the said opening.

In one embodiment, the second airflow modifier device comprises a plurality of air twist blades mounted on an inner wall of the combustion chamber in close proximity to the air escape channel around the periphery of the first airflow modifier device. The air twist blades are typically angled so as to direct the air into a vortex. An advantage of this arrangement is that the air twist blades can easily be retrofitted into an existing burner combustion chamber.

The direction of twist imparted by the second airflow modifier device may be opposite to a direction of twist imparted by the first airflow modifier device.

The second airflow modifier device is typically provided with a plurality of angled blades ("air twist blades") which impart helical motion to the airflow.

In a preferred embodiment, both the first airflow modifier device and the second airflow modifier device are arranged to twist airstreams passing therethrough in opposite directions.

The combination of the first and second airflow modifier devices provides much more effective mixing of the atomised fuel and air thereby facilitating more complete combustion and reducing emissions of partial combustion products such as carbon monoxide.

Preferably, means are provided for varying the size of the air escape channel around the periphery of the first airflow modifier so as to vary the flow of excess air into the combustion chamber.

For example, in one embodiment, the first airflow modifier device may be mounted so as to be movable forwards or backwards along an axial path so as to vary the size of the air escape channel.

In another embodiment, a movable baffle element is provided which can be moved (for example in an axial direction) to reduce or increase the size of the air escape channel.

The first airflow modifier device is typically configured to impart twist to a stream of air passing through it. Thus, for example, it can take the form of a swirl plate comprising a plurality of radially extending vanes arranged so as to twist the flow of air into a vortex.

The burner nozzle is conveniently mounted in a central opening in the swirl plate.

The first airflow modifier device may have a peripheral surface which is shaped so as to direct excess air through the air escape channel. For example, the peripheral edge or surface may be inclined at an angle of from 20° to 70°, typically 30° to 60° (more typically 40° to 50°, for example approximately 45°) with respect to the plane of the first airflow modifier device. The angle of inclination of the surface is such that air incident on the surface is directed outwardly and around the first airflow modifier device and into the combustion chamber.

Means may be provided for varying the gap around the periphery of the first airflow modifier device so as to vary the flow of excess air into the combustion chamber. Thus, the gap may be reduced to reduce the flow of excess air around the periphery of the first airflow modifier device, or it may be widened to increase the flow of excess air into the combustion chamber.

In one embodiment of the invention, the gap around the periphery of the first airflow modifier device is defined by the distance between an outer edge of the first airflow modifier device and an inner rim of the upstream opening of the combustion chamber. In this embodiment, the size of the gap can be controlled by moving the first airflow modifier device with respect to the inner rim of the said opening.

For example, movement of the first airflow modifier device backwards or forwards in an axial direction will result in the size of the gap changing.

In an alternative embodiment, the first airflow modifier device is immovable so that the distance between the outer edge of the air director element and an inner rim of the upstream opening of the combustion chamber is fixed, and a movable baffle element is provided which can be moved into or out of the gap to vary the size of the gap. The movable baffle element can be, for example, an annular element which is movable backwards and forwards in an axial direction.

In a further embodiment, the first airflow modifier device is movable with respect to the inner rim of the said opening so as to vary the size of the gap therebetween and a movable baffle element is provided which provides further control over the size of the gap.

The first airflow modifier device, when movable, may be mounted on a support frame or support rods which are movable, for example by virtue of being mounted on or linked to an actuator such as an electrical motor or solenoid-driven actuator or a pneumatic or hydraulic ram. The first airflow modifier device may be mounted in a plurality (e.g. three or four) of support rods, each of which is mounted on an actuator. Thus, for example, there may be three or four such actuators which move the support rods.

The first airflow modifier device and the fuel-atomising burner nozzle can be mounted on a movable support frame which is connected to one or more actuators such as electrical motor or solenoid-driven actuators or pneumatic or hydraulic rams. The support frame may advantageously be movable along a track provided by one or more stationary support rails. In one embodiment, the support frame is suspended from a stationary support rail.

An ignition device such as an ignition lance is typically provided for igniting the atomised fuel when the burner is started up. The ignition device (e.g. lance) can, for example, be mounted on the movable support frame, when present.

The burner is preferably provided with diagnostic means for measuring at least one characteristic of a flame produced by the burner and/or at least one characteristic of the combustion gases produced by the burner. For example, the diagnostic means may provide information on the colour or shape of the flame and may therefore provide information about the extent of combustion of the fuel.

In one embodiment, the diagnostic means comprises a photocell.

Alternatively, or additionally, the diagnostic means may comprise one or more instruments at a location downstream of the burner for monitoring the composition of the combustion gases (e.g. carbon monoxide content) produced by the burner.

Information provided by the diagnostic means enables an operator of the burner to assess whether combustion is taking place efficiently and hence whether more or less excess air is required. The size of the air escape channel (e.g. the gap around the periphery of the first airflow modifier device) can be varied in response to information provided by the diagnostic means. This can be done manually, automatically or semi-automatically. An electronic controller (e.g. a computer) can be used to process information received from the diagnostic means and then send appropriate signals to the actuators for increasing or reducing the size of the air escape channel.

The combustion chamber can be constructed so as to be adjustable in length. For example, the combustion chamber may be formed from two or more telescopic components which can be moved together to reduce the length of the combustion chamber or moved apart to increase the length of the combustion chamber.

For example, one component of the combustion chamber may be fixed and another component may be movable with respect to the one component. The movable component of the combustion chamber may be mounted on one or more movable support rods or a movable support frame.

An advantage of having a combustion chamber of adjustable length is that when installing or commissioning the burner, the length of the combustion box can be adjusted to produce a desired shape of the flame to suit the particular dimensions and circumstances of use of the dryer in which the burner is mounted.

For example, the combustion box can be shortened to accommodate or form a shorter wider flame or can be lengthened to accommodate or form a longer narrower flame.

In a second aspect, the invention provides a burner configured for use with a dryer for drying aggregates, the burner comprising:

a burner chamber in which is mounted a fuel-atomising burner nozzle and means for conveying fuel to the burner nozzle;

means providing a flow of air for the burner;

a combustion chamber in which the fuel is burnt; the combustion chamber having an opening at an upstream end communicating with the burner chamber and an opening at a downstream end thereof for passing combustion gases and heated air into a drying chamber of the dryer; the burner nozzle being arranged to direct a flow of atomised fuel into the combustion chamber;

a first airflow modifier device mounted in or across the opening at the upstream end of the combustion chamber such that there is a gap constituting an air escape channel around a periphery of the first airflow modifier device, the first airflow modifier device having one or more windows therein through which a flow of air provided by the fan is directed into the combustion chamber to mix with atomised fuel from the burner nozzle, the one or more windows being configured to impart turbulence to the airflow;

wherein the combustion chamber is constructed so as to be adjustable in length; and optionally wherein:

(i) a second airflow modifier device comprising one or more air deflector elements mounted peripherally about the opening at the upstream end of the combustion chamber, the second airflow modifier device being arranged to impart turbulence to excess air passing through the said air escape channel; and/or (ii) means are provided for varying the size of the air escape channel so as to vary the flow of excess air into the combustion chamber.

Unless the context requires otherwise, each of the optional features, preferences and embodiments set out above in relation to the first aspect of the invention apply also to the above second aspect of the invention.

In each of the foregoing aspects and embodiments of the invention, the burner comprises means providing a flow of air through the burner chamber and into the combustion chamber.

The means providing a flow of air through the burner chamber typically comprises an air intake, a fan and a motor for driving the fan.

The fan can be contained within a fan chamber, the fan chamber being provided with an air inlet and an air outlet.

The fan, fan chamber, air inlet and air outlet and motor for driving the fan can together constitute a blower module.

The blower module can be mounted on an underlying support structure.

The underlying support structure can have one or more air inlets communicating with the air inlet of the fan chamber. The one or more inlets of the support structure and an air inlet of the fan chamber may together constitute a main (or sole) air intake of the burner. An advantage of having the main (or only) air intake located beneath the blower module is that it reduces the overall length of the burner.

The interior of the support structure is preferably insulated with acoustic foam to reduce noise associated with the intake of air.

The blower module can be constructed so that it can be separated from the burner chamber to allow access to the burner chamber for maintenance purposes.

In one embodiment, the blower module is movably mounted on the support structure so that it can be moved away from the burner chamber to give access to the burner chamber.

The support structure and the blower module can be provide with mutually engaging wheels, rollers and a track to enable the blower module to be moved away from the burner chamber.

In a third aspect, the invention provides a burner configured for use with a dryer for drying aggregates, the burner comprising:

a burner chamber in which is mounted a fuel-atomising burner nozzle and means for conveying fuel to the burner nozzle;

a blower module which provides a flow of air through the burner chamber and into the combustion chamber;

a support structure on which the blower module is mounted;

a combustion chamber in which the fuel is burnt; the combustion chamber having an opening at an upstream end communicating with the burner chamber and an opening at a downstream end thereof for passing combustion gases and heated air into a drying chamber of the dryer; the burner nozzle being arranged to direct a flow of atomised fuel into the combustion chamber;

wherein the blower module is movably mounted on the support structure so that it can be moved away from the burner chamber to provide access to the interior of the burner chamber.

Unless the context requires otherwise, the burner chamber, blower module, support structure and combustion chamber may be provided with any one of more of the features set out above in relation to the first and second aspects of the invention.

For example, the burner may be provided with a first and optionally a second airflow modifier device as hereinbefore defined, and means may be provided as defined herein for varying the size of an air escape channel at the periphery of the first airflow modifier device so as to vary the flow of excess air into the combustion chamber.

Furthermore, the combustion chamber may be variable in length as hereinbefore defined.

In each of the foregoing aspects and embodiments of the invention, there is provided a means for conveying fuel to the burner nozzle.

The means for conveying fuel to the burner nozzle will typically comprise one or more pipes or tubes and a valve for controlling the supply of fuel to the burner nozzle.

In one preferred embodiment of the invention, the valve for controlling the supply of fuel to the burner is capable of controlling fuel flow from several different fuel sources.

A fuel valve capable of controlling the supply of fuel from several different fuel sources represents a further aspect of the invention.

Accordingly, in a fourth aspect, the invention provides a fuel valve for connecting a burner to two separate fuel supplies, the fuel valve comprising:

- a valve body having a main throughbore in which are located a rotatable valve member and a pair of obturator elements;
- the valve member having a pair of transverse channels therethrough and the valve body having a plurality of passageways therethrough which, together with the transverse channels of the valve member, form a pair of separate flow paths, both flow paths having an outlet for connection to the burner, a first of the flow paths having an inlet for connecting to a first fuel supply and a second of the flow paths having an inlet for connecting to a second fuel supply;
- the valve member being rotatable between an open position, in which one or both of the transverse channels of the valve member are in alignment with their respective flow paths to permit fuel flow through the valve, and a closed position in which the said transverse channels are out of alignment with their respective flow paths thereby to prevent fuel flow through the valve;
- and wherein the obturator elements are each independently movable along the main throughbore to provide a controlled degree of obturation of the transverse channels thereby to regulate the rate of flow of fuel through the valve.

In the dual fuel valve of the invention, a rotatable valve member is mounted in a main throughbore passing through the valve body. The rotatable valve member has a pair of transverse channels passing through it. The valve member can be rotated so that the transverse channels move into or out of alignment with the passageways through the valve body, thereby to allow or prevent flow of fuel through the valve. The term "transverse" as used herein means that the channels extend in a sideways direction relative to the rotational axis of the valve member. The transverse channels may be oriented perpendicularly with the respect to the rotational axis of the valve member or they may be oriented at an angle of less than 90° with respect to the axis. Preferably the transverse channels extend in a straight line from one side of the valve member to the other.

The rotatable valve provides a means of turning the fuel flow on and off. The transverse channels may be arranged so that both flow paths are opened at the same time or they can be arranged so that only one flow path is opened at a time. One or more additional transverse channels may be present in the valve member to provide the option of opening both flow paths simultaneously or one at a time.

Each obturator element is typically provided with a window which can be moved into or out of alignment with the transverse channels of the valve member and adjacent passageways of the valve body so as to regulate flow of fuel through the valve. The valve is preferably provided with means for controlling the extent of overlap between the window in each obturator element with the transverse channels thereby controlling the size of the aperture through which the fuel can pass. Although the obturator elements could in principle be used for fine control of fuel flow when the burner is in use, in practice the size of the aperture is typically set prior to use of the burner depending on the size and rate of fuel consumption of the burner and the type of fuel being burnt. Thus, for example, a light gas oil will typically require a smaller aperture than a more viscous waste oil and the valve will be set up before use accordingly.

In a preferred embodiment, the obturator elements are cylindrical in form and have a central throughbore in which the valve member sits. The cylindrical obturator elements may be located in enlarged bore regions at either end of the main throughbore of the valve body.

The obturator elements are movable in an axial direction along the main throughbore. Preferably means are provided for being about incremental axial movement of the obturator elements. For example, the obturator elements may be provided at an outer end thereof with a thread which engages a correspondingly threaded rotatable element, rotation of which is converted into axial movement of the obturator element.

The positions of the obturator elements may be adjusted manually, or one or more actuators may be provided to bring about controlled axial movement of the obturator elements. For example, when the obturator element is provided with a thread which engages a correspondingly threaded rotatable element, the rotatable element may be connected to an actuator which imparts controlled rotation to the rotatable element.

The valve body may be formed as a solid body, e.g. a block which has a plurality of passages passing through it. The passages can be formed by machining, casting, moulding or a combination thereof. In one embodiment, the block is formed from a metal material.

The term "throughbore" as used herein is used in a general sense to refer to a passageway or channel which passes through the valve body from one side of the body to another and is not intended to imply any particular means (e.g. drilling) of forming the channel or passageway.

The transverse channels of the valve member and the plurality of passageways through the valve body together form a pair of separate flow paths, one for each fuel supply. In general, the two flow paths are isolated from one another so that different fuels passing through the valve do not mix.

Each flow path may be connected to a secondary flow path which bypasses the valve member. The secondary flow path is provided with one or more valves for controlling flow of fuel therethrough. The secondary flow path is typically of smaller bore than each main flow path.

The secondary flow path can be used to allow a limited amount of fuel to pass through the valve when the valve member is in the closed position. For example, the secondary flow path can be connected to an igniter or pilot flame nozzle so that a pilot flame can be lit before the burner is turned on fully. Once the burner has been fully turned on, the secondary flow path can be closed.

A meter for measuring fuel flow can advantageously be mounted in the secondary flow path.

Typically, an on-off valve will be provided in a fuel upstream of the inlets for each flow path. The on-off valve can be a solenoid valve, for example.

The fuel valve of the fourth aspect of the invention can be used with the burners of each of the first, second and third aspects of the invention.

The burners of the invention are intended for use as part of an apparatus for drying materials such as aggregates. The combustion chamber of the burner in use is typically mounted adjacent or at least partially within a drying chamber of a dryer.

For example, when the dryer is a rotating drum dryer of the type described in the introductory part of this application, the combustion chamber of the burner can be mounted in an end wall of the rotating drum.

In a further aspect, the invention provides a dryer apparatus (e.g. a rotating drum dryer apparatus) comprising a burner as hereinbefore defined.

The invention also provides a method of drying aggregates, which method comprises passing the aggregates through a dryer apparatus (e.g. a rotating drum dryer apparatus) comprising a burner as hereinbefore defined.

The invention will now be described in more detail, but not limited, by reference to the specific embodiments illustrated in the accompanying drawings FIGS. 1 to 6.

BRIEF DESCRIPTION OF THE DRAWINGS

FIG. 10 is partial sectional side elevation showing an alternative layout for the burner chamber and combustion chamber but with a number of features omitted for clarity.

DETAILED DESCRIPTION OF THE INVENTION

Figure 1A:
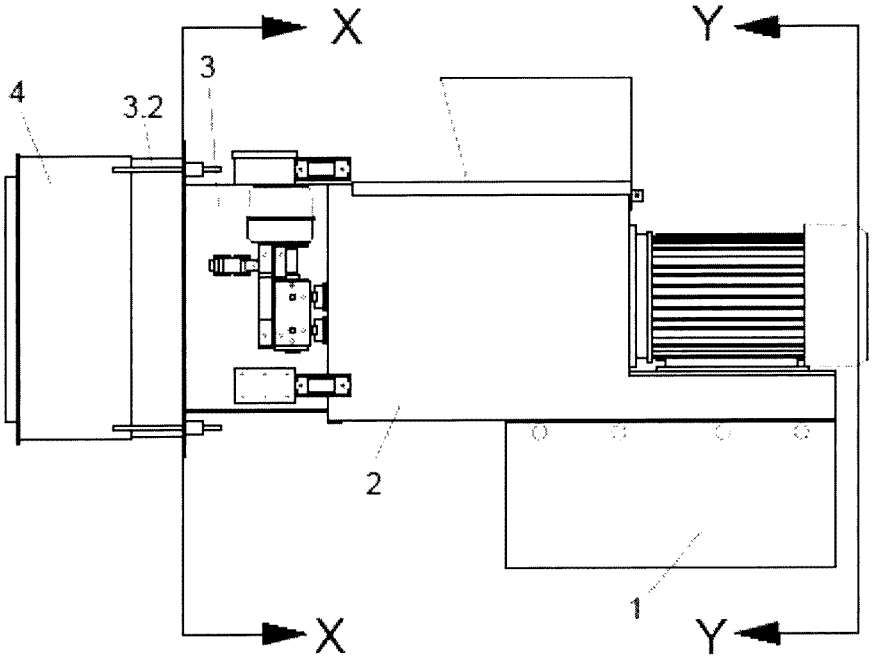
FIG. 1A is a side view of a burner apparatus according to one embodiment of the present invention.
Figure 1B:
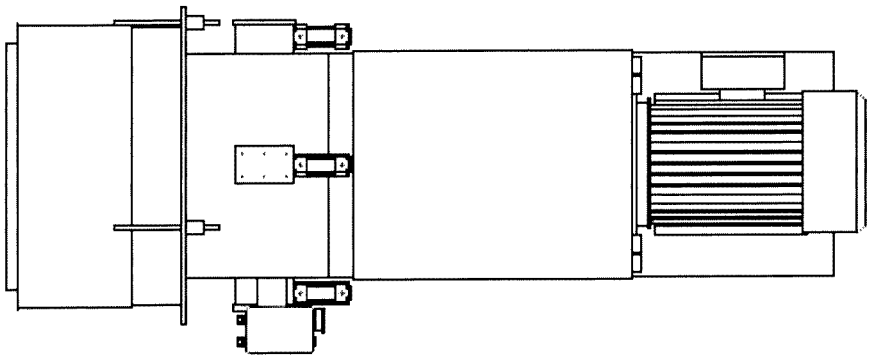
FIG. 1B is a view from above of the burner apparatus of FIG. 1A.
Figure 1C:
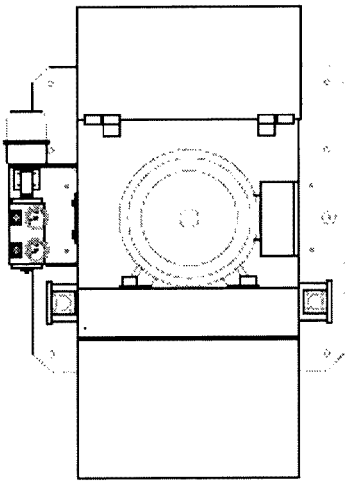
FIG. 1D is a view from direction X-X in FIG. 1A.
Figure 1D:
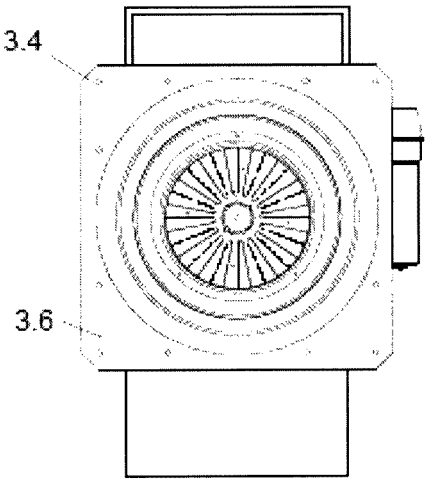
Figure 4B:
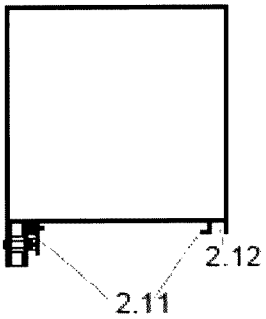
FIG. 4B is a view from direction X of FIG. 4A but with some features omitted for clarity.

Referring to the drawings, FIGS. 1A to 1D show a burner apparatus according to one embodiment of the invention.

The burner apparatus comprises a support structure 1, a blower module 2, a burner chamber 3 and a combustion chamber 4.

Figure 2A:
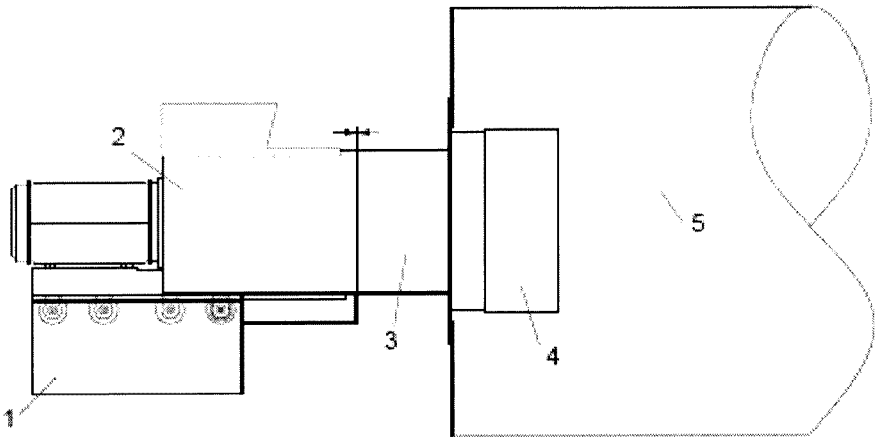
FIG. 2A is a schematic side elevation showing the burner apparatus of FIGS. 1A to 1D mounted in an end wall of a rotary dryer.
Figure 2B:
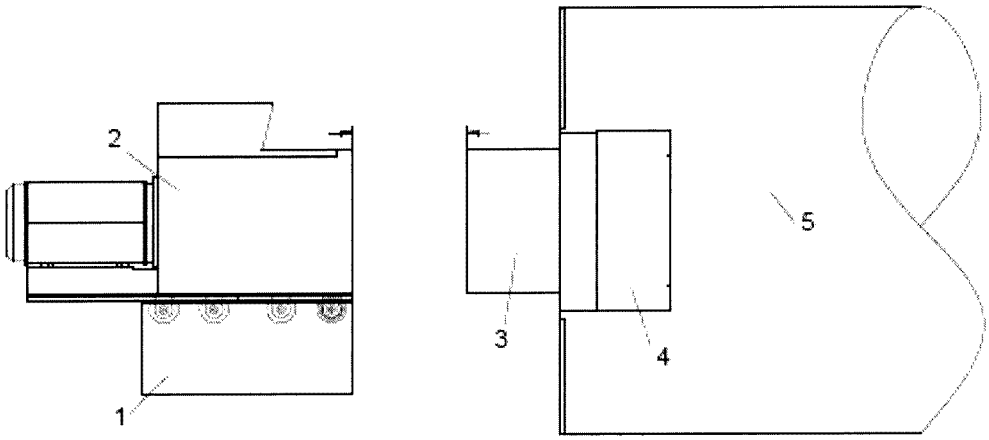
FIG. 2B is a schematic side view corresponding to FIG. 2A but showing the blower module rolled back from the burner chamber and the combustion chamber of the burner apparatus.
Figure 3A:
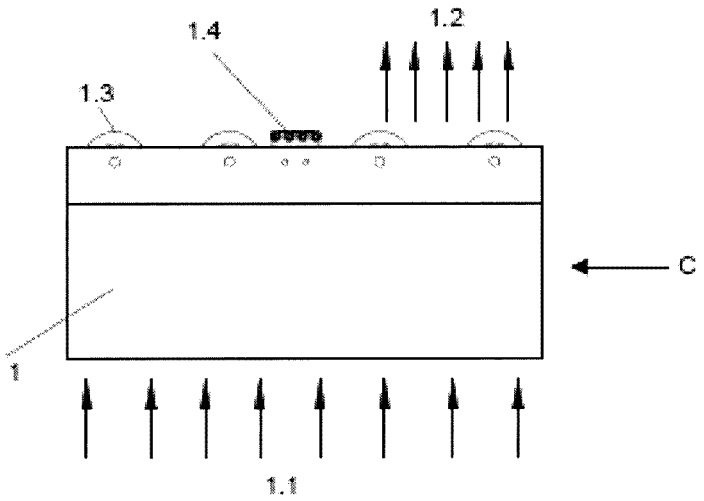
FIG. 3A is a side view of the support structure for the burner apparatus of FIGS. 1A to 1D.
Figure 3B:
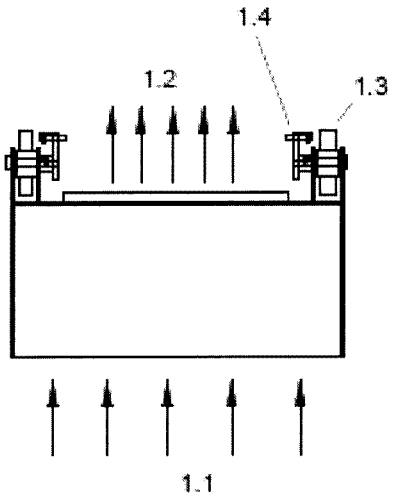
FIG. 3B is an end view of the support structure of FIG. 3A.

The burner apparatus in use is mounted at one end of a rotary dryer 5 (see FIGS. 2A and 2B) by means of bolts 3.2 passing through holes 3.4 in a flange 3.6 located at the junction between the burner chamber 3 and combustion chamber 4. The blower module 2 is mounted on a support structure 1 which is provided with a plurality (in this case four) of pairs of rollers 1.3 which run in channels 2.12 on the underside of the blower module 2. The inner wall 2.11 of the channel 2.12 is turned inwardly and engages retaining rollers 1.4 on the support structure 1.

The support structure 1 serves not only to take the weight of the blower module 2 but also serves as an air intake for the blower module. Typically, in use, the support structure 1 is mounted on a platform at one end of the rotary dryer. The platform may have ventilation openings so that air may pass through the platform and up through the support structure and into the fan chamber. Preferably, however, the support structure 1 is provided with feet (not shown) at each corner which elevate the support structure so that there is a gap of about 10 centimeters between the underlying surface and the support structure through which air can pass en route to the fan chamber. The support structure is configured such that at least 50% of the air required by the burner passes up through the support structure. An advantage of this arrangement is that the overall length of the burner can be reduced.

In order to reduce the noise associated with the burner, the support structure 1 contains acoustic foam to give noise reduction insulation so that the structure functions as a silencer as well as a support for the blower module.

Figure 4A:
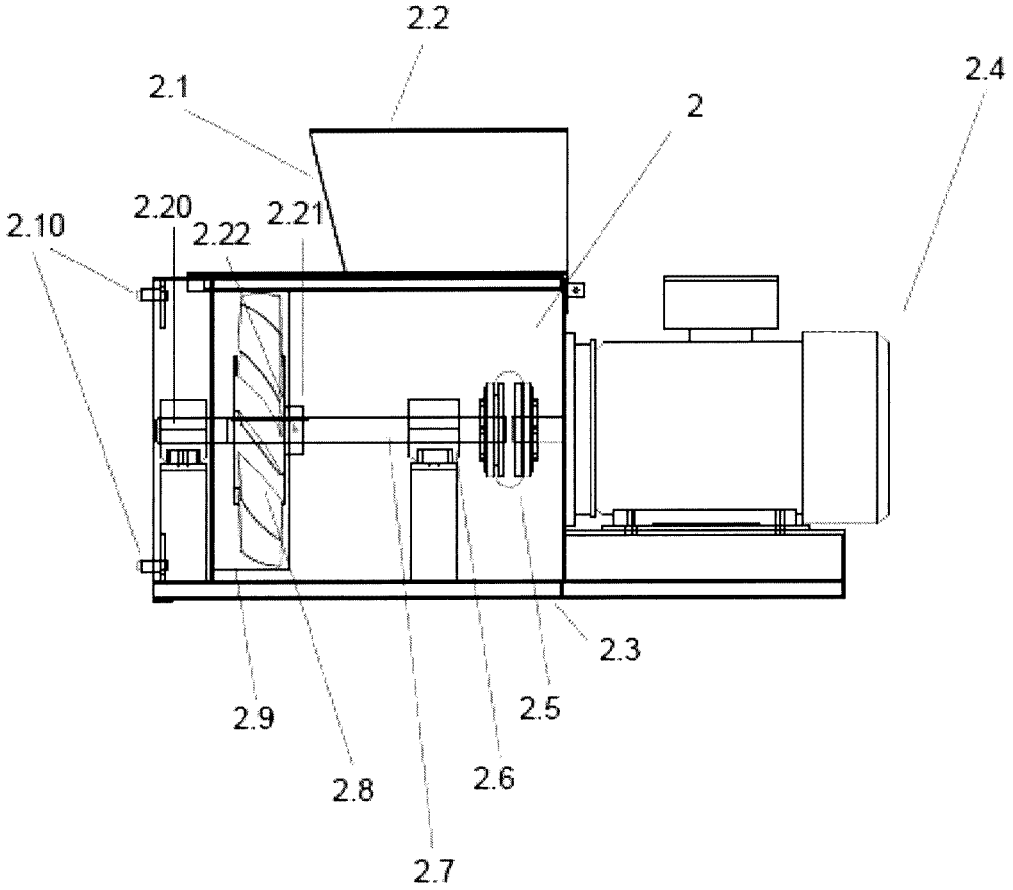
FIG. 4A is a partial sectional elevation of the lower section showing the interior of the fan chamber of the blower module.

FIG. 4A shows the interior workings of the blower module. Thus, the blower module comprises a motor 2.4 which is connected via a short shaft to a drive coupling 2.5. The drive coupling 2.5 in turn is connected to the impeller shaft 2.7 which rotates the impeller or fan 2.8. The impeller is attached to the shaft 2.7 by means of a collar 2.21 which is secured to the shaft by means of one or more grub screws 2.22. At one end, the shaft 2.7 is mounted in a bearing 2.20, the construction of which is entirely conventional and need not be described in detail here. The impeller shaft 2.7 is also supported within bearing housing 2.6 which, again, is of conventional construction.

On its upper surface, the blower module is provided with a hinged inlet 2.2 which is fitted with acoustic foam to assist noise reduction. The inlet 2.2 can be lifted up on its hinges to allow access to the interior workings of the blower section.

The blower module is provided with locating pins 2.10 which locate in the pin locators 3.14 on the combustion chamber module 3 to provide correct alignment between the blower module and the combustion chamber module.

Figure 5:
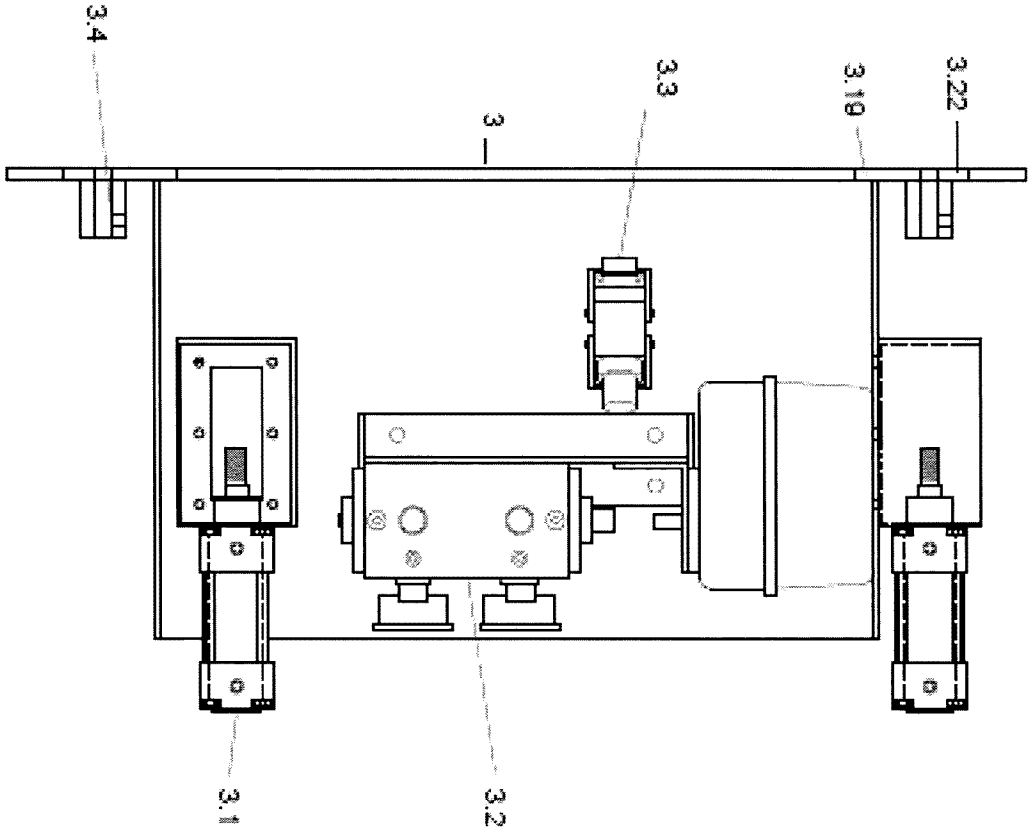
FIG. 5 is an external side view of the burner chamber of the burner apparatus of FIGS. 1A to 1D.

FIG. 5 shows the external features of the burner chamber 3. As shown, the burner chamber has an end wall 3.19, the radially outermost part of which forms a flange 3.22 fitted with support studs 3.4 for attaching the combustion chamber 4. Mounted on the external surface of the burner chamber 3 are three pneumatic rams 3.1, one at the top of the burner chamber and the other two being mounted either side of the lower part of the burner chamber.

Also mounted on the outer surface of the burner chamber is a dual fuel valve 3.2, the construction of which is illustrated in more detail in FIGS. 12, 13A to 13F, 14 and 15.

A photocell holder 3.3 containing a photocell device for flame diagnostics purposes is also attached to the outer surface of the burner chamber.

Figure 6:
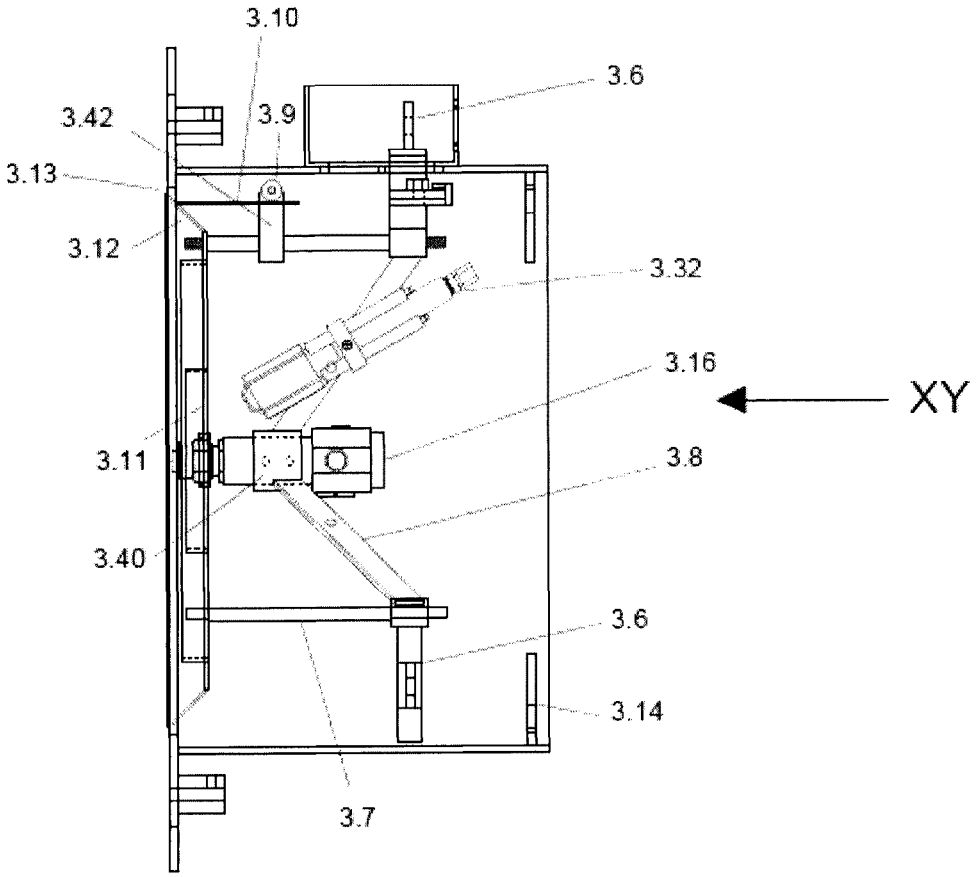
FIG. 6 is a sectional view showing the interior of the burner chamber of FIG. 5.

The interior workings of the burner chamber are shown in FIG. 6. Thus, mounted in the wall of the burner chamber 3 are pneumatic ram brackets 3.6 which are attached to the external pneumatic rams 3.1. Each pneumatic ram bracket 3.6 is attached to a swirl plate support rod 3.7 and also to an arm of the lance support spider 3.8. The three arms of the lance support spider are linked by means of a collar 3.40 which holds the burner lance 3.16. Mounted on one of the arms of the spider 3.8 is an ignition lance 3.32. The upper swirl plate support rod 3.7 is attached to a suspending arm 3.42, which has a wheel or roller 3.9 on its upper end. The wheel or roller rests on a support or guide rail 3.10.

A swirl plate 3.11 (which constitutes a first airflow modifier device) is secured to the lance 3.16 and also to the swirl plate support rods 3.7. At the periphery of the swirl plate 3.11 is an air is an inclined surface 3.12 which is inclined at an angle of about 45° with respect to the plane of the swirl plate 3.11.

The end wall 3.19 of the burner chamber has a circular hole in which the swirl plate 3.11 sits. In the rest position, there is a relatively small annular gap 3.13 between the outer surface 3.12 and the rim of the hole in the end wall 3.19. The size of the air gap 3.13 can be increased by actuating the pneumatic rams 3.1 so that the swirl plate 3.11 is moved in a forward direction.

Figure 7:
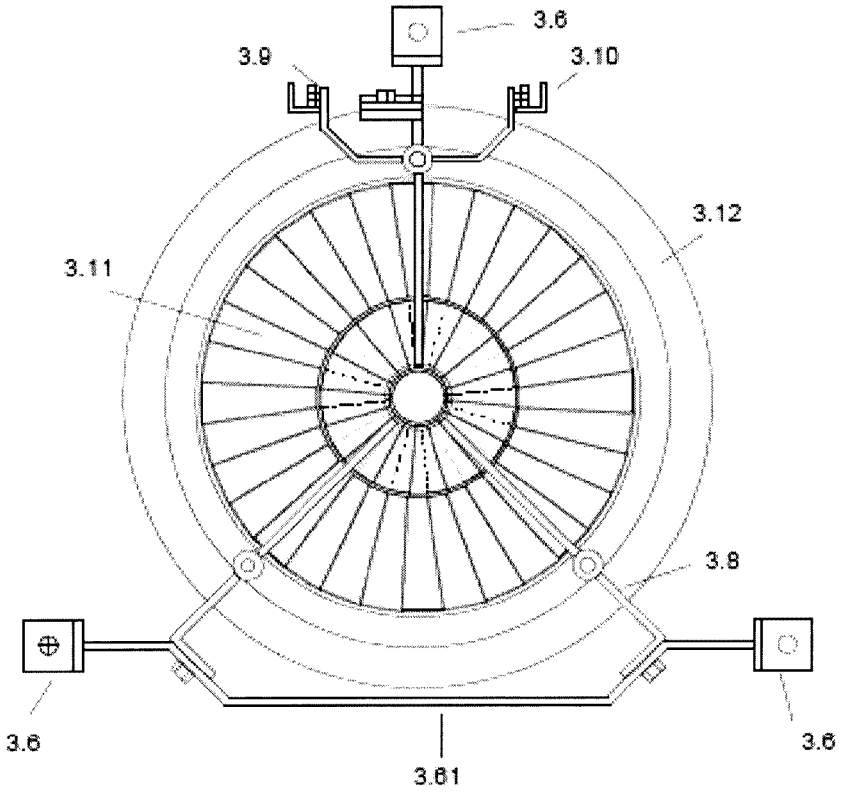
FIG. 7 is a view from direction X of the burner chamber shown in FIG. 6, but with some features omitted for clarity.

The configuration of the swirl plate 3.11 can be seen more clearly in FIG. 7. As shown, the swirl plate comprises a plurality, in this embodiment thirty two, of radial vanes which are inclined at an angle of about 45° relative to the plane of the swirl plate. In the embodiment shown, the vanes are inclined so as to impart an anticlockwise twist to air passing therethrough.

Figure 8:
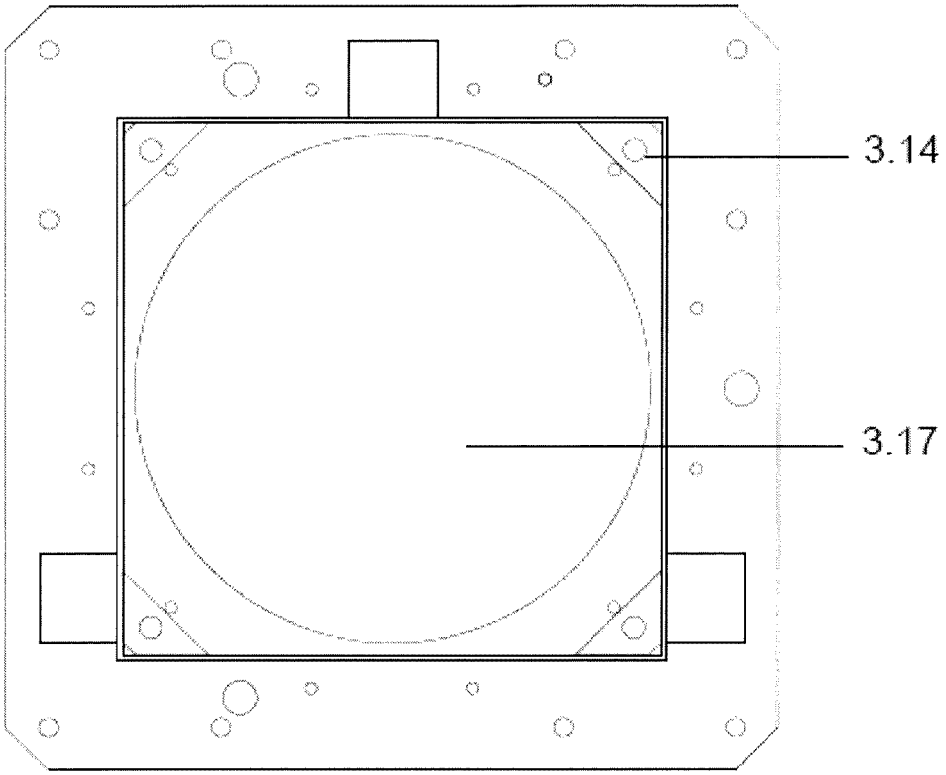
FIG. 8 is a view from direction X of the burner chamber shown in FIG. 6 but with the interior workings of the burner chamber omitted.

The support spider 3.8, lance 3.16, ignition lance 3.32 and swirl plate 3.11 can all be removed from the burner chamber 3 by removing the two bolts on the ram bracing bar 3.61 and the bolt on the pneumatic ram top support 3.6. As shown in FIG. 8, removal of the support spider 3.8 and its attached components gives access through the round outlet hole 3.17 into the combustion chamber 4.

Figure 9:
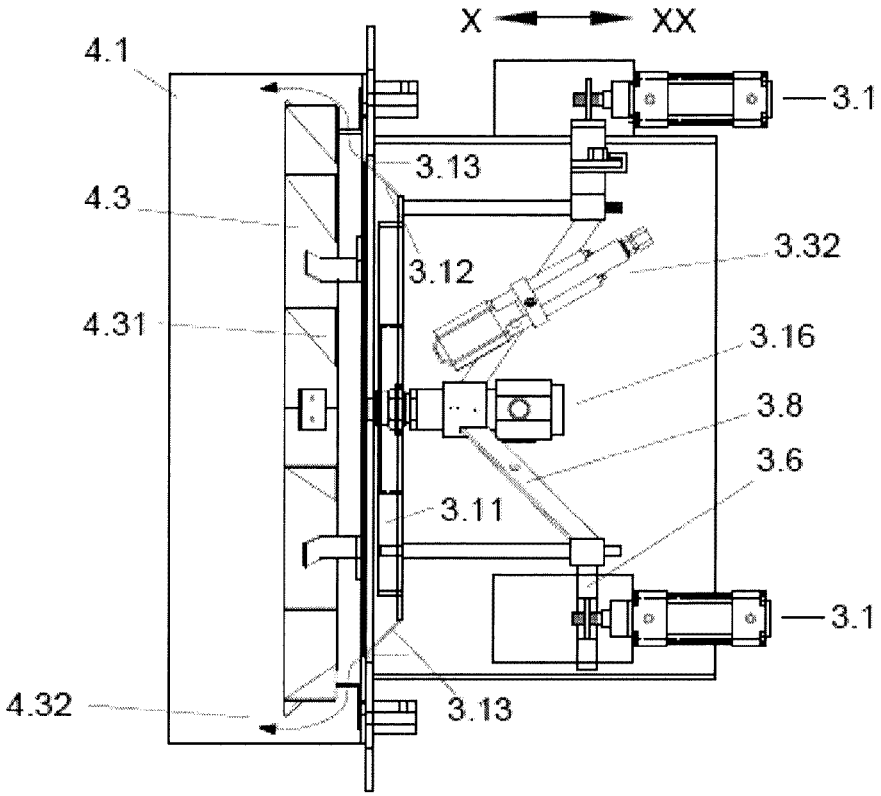
FIG. 9 is a side elevation showing the interior of the burner chamber together with part of the combustion chamber.
Figure 10:
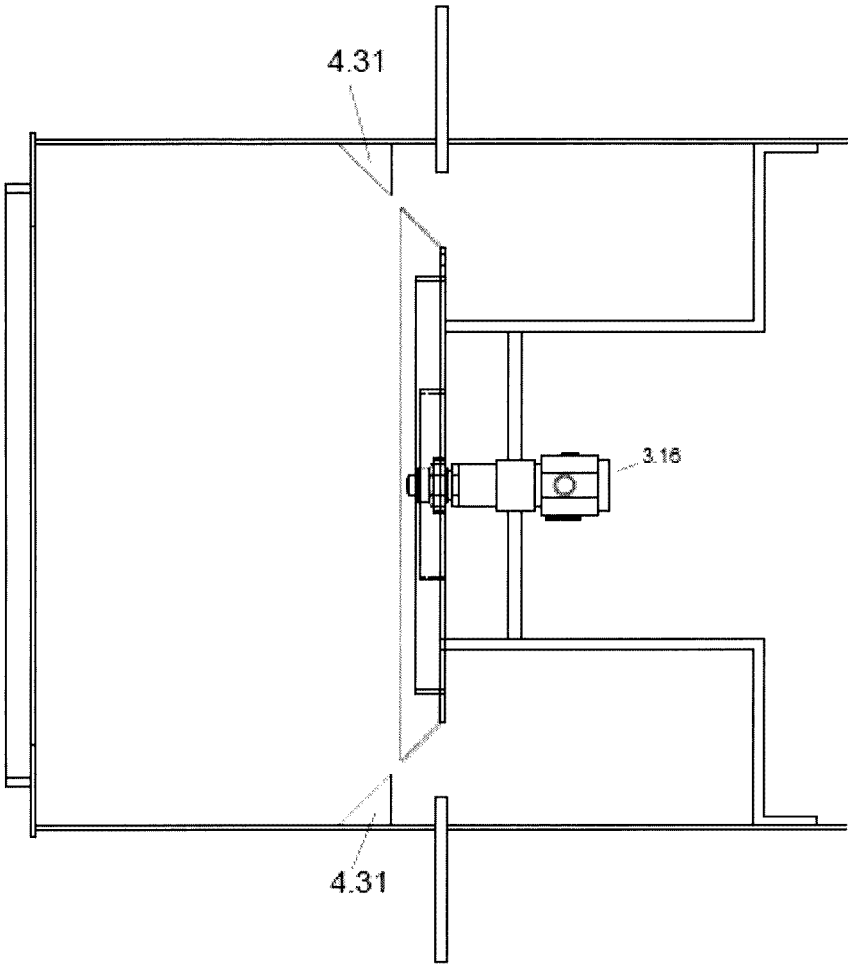
FIG. 10 is a view from direction Y of the burner apparatus of FIGS. 1A and 1B.

FIG. 9 illustrates the interior of the burner chamber and a part of the interior of the combustion chamber immediately downstream of the burner chamber. Mounted on the end wall 3.19 of the burner chamber 3 and encircling the first airflow modifier device is a fixed second airflow modifier device 4.3 which is fitted with air twist blades 4.31. The air twist blades 4.31 are inclined at an angle of about 45° with respect to the central axis of the burner and impart a twist to the airstream which is in the opposite direction to the twist imparted to the airstream by the swirl plate 3.11. By arranging the swirl plate 3.11 and the a second airflow modifier device such that they twist the airstream in opposed directions, the turbulence of the airstream is increased and therefore the efficiency of mixing of the combustion air with atomised fuel oil is greatly improved.

Figure 11:
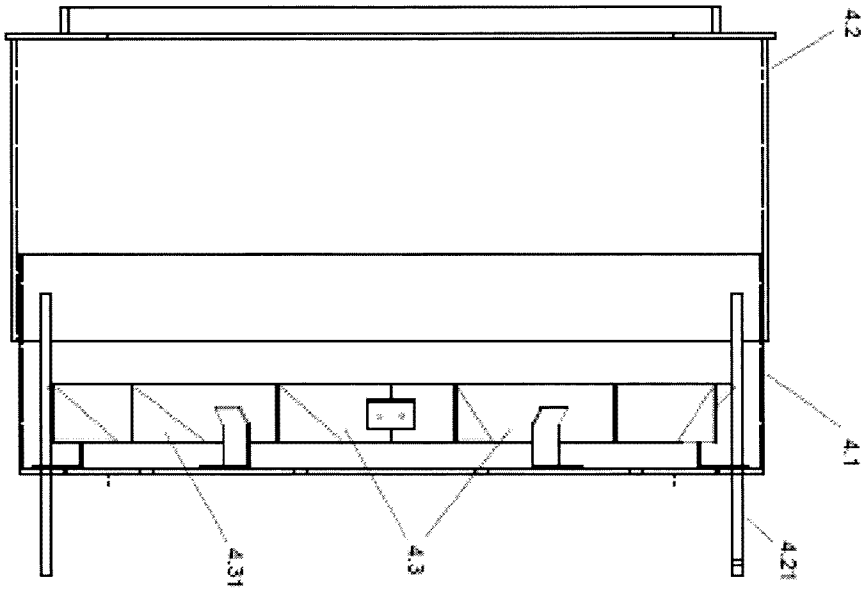
FIG. 11 is a side sectional elevation showing the interior of the combustion chamber of the burner apparatus of FIGS. 1A to 1D.
Figure 12:
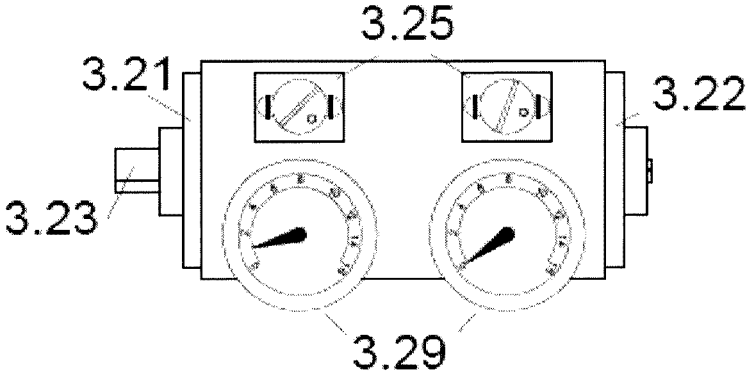
FIG. 12 is a view from one side of the dual fuel valve for use in the burner apparatus of FIGS. 1A to 1D.
Figure 13A:
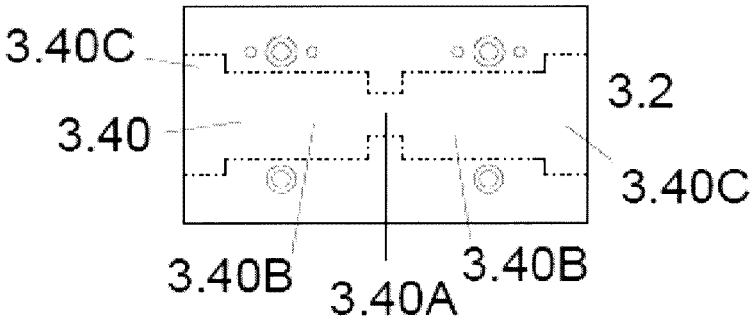
FIGS. 13A to 13F show the component parts of the dual fuel valve of FIG. 12.
Figure 13B:
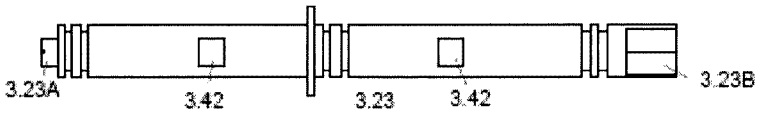
Figure 13C:
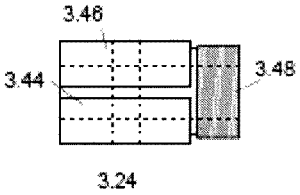
Figure 13D:
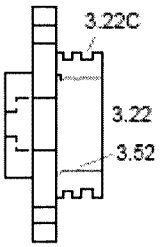
Figure 13E:
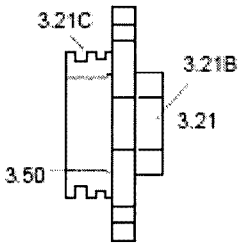
Figure 13F:
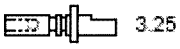
Figure 14:
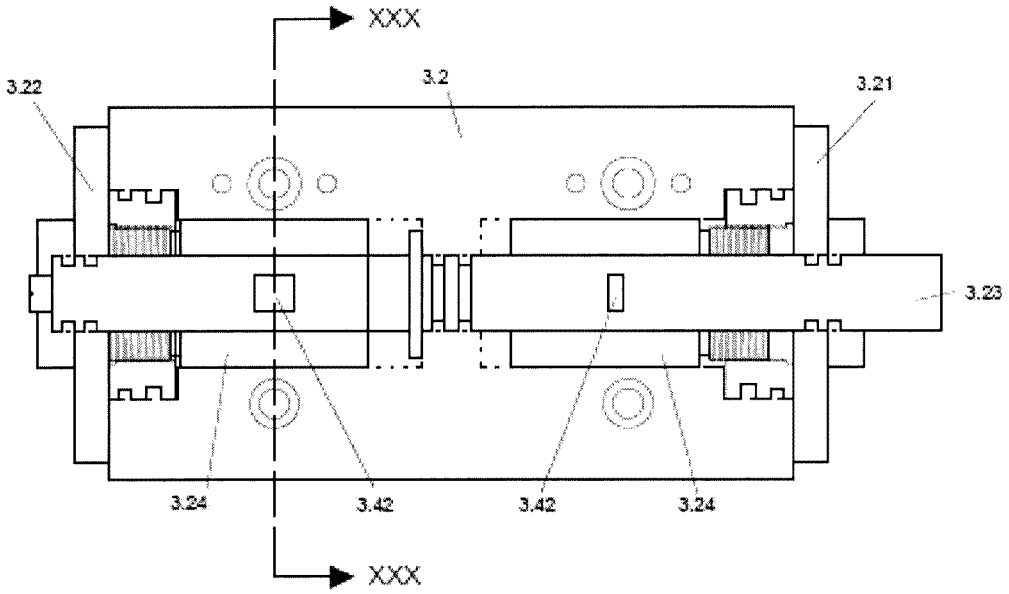
FIG. 14 is a sectional elevation through the fuel valve of FIG. 12.
Figure 15:
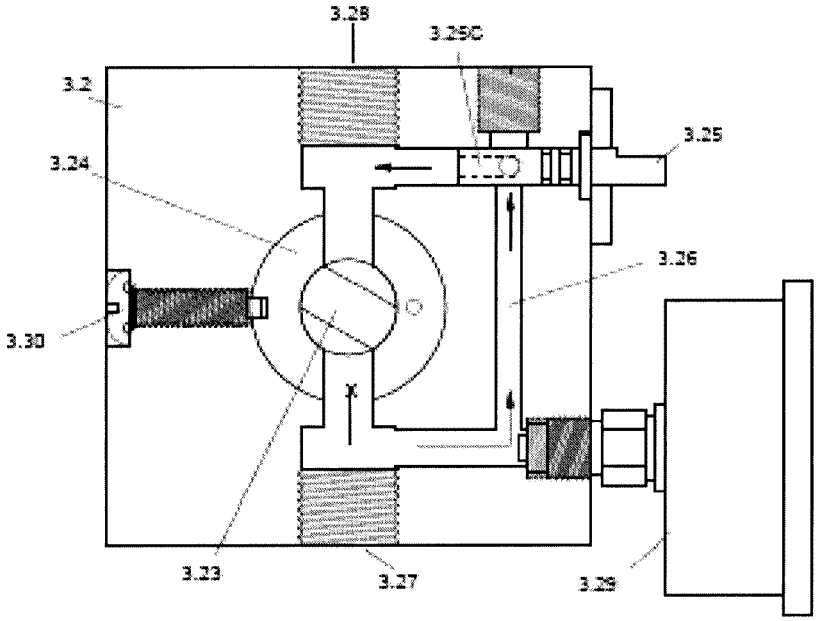
FIG. 15 is a side elevation along line XXX-XXX in FIG. 14.

The combustion chamber 4 can be of fixed length or it can be of adjustable length as shown in FIG. 11. The combustion chamber of FIG. 11 comprises a fixed combustion chamber section 4.1 and an adjustable combustion chamber section 4.2. The adjustable combustion chamber section 4.2 has attached thereto a plurality (e.g. three) of combustion chamber support rods 4.21 which are mounted in the combustion chamber support studs 3.4. The combustion chamber can therefore be extended in length by means of telescopic movement between the fixed combustion chamber section 4.1 and the adjustable combustion chamber section 4.2. By enabling the length of the combustion chamber to be varied, it is possible to vary the shape of the flame from a short and wide flame to a long and narrow flame.

Figure 16:
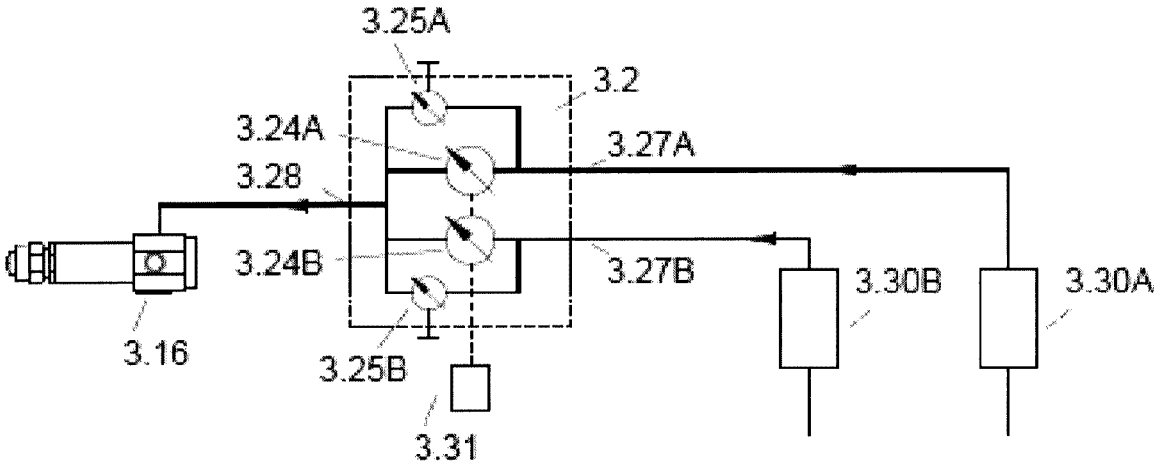
FIG. 16 is schematic view of the fuel pipe work including the dual fuel valve and the burner.

The fuel feed to the lance 3.16 is shown in more detail in FIG. 16. The supply of fuel oil is controlled by the dual fuel valve 3.2. The fuel valve 3.2 is fed by a pair of fuel inlet pipes 3.27A and 3.27B which in turn are linked to solenoid valves 3.30A and 3.30B respectively. Each of the solenoid valves 3.30A and 3.30B is connected to a fuel reservoir or supply. The fuel supplies may be identical or different fuels. A choice of fuel for use in the burner can be made by activating the appropriate solenoid valve 3.30A or 3.30B.

Referring to FIGS. 12 to 15, the dual fuel valve 3.2 comprises a machined metal block having a main throughbore 3.40 extending across its width. The main throughbore 3.40 is divided into a narrow bore region 3.40A at the midpoint of the channel, a pair of intermediate bore regions 4.40B and two enlarged bore regions 3.40C at either end of the channel 3.40. Disposed within the main throughbore is a rotatable valve member 3.23 which has two transverse passages 3.42 extending from one side to the other. In this embodiment, the transverse passages 3.42 are square in shape and are approximately 10 millimeters square. However, the size of the transverse channels could be varied as desired. Disposed within the intermediate bore regions 3.40B of the block are a pair of cylindrical obturator elements 3.24 which are slidable in an axial direction along the main throughbore 3.40. Each obturator element has a central passageway 3.44 which is sized so that it can accommodate the valve member 2.3. Each obturator element also has a pair of square cross-section transverse passages (windows) 3.46 of the same cross-sectional area as the transverse passages 3.42 in the rotatable valve member 3.23.

The obturator elements 3.24 each have threaded ends 3.48. A threaded end of one obturator element is attached by means of a thread on the radially inner surface 3.50 of span adjuster 3.21 whereas the threaded end 3.48 of the other obturator element 3.24 is attached by means of a thread on the radially inner surface 3.52 to the other span adjuster 3.22. The span adjuster 3.22 is configured to fit over the end 3.23*a* of the fuel adjustment stem 3.23 whereas the span adjuster 3.21 has a reduced diameter opening 3.21B through which the end 3.23B of the rotatable valve member adjustment stem 3.23 can be inserted.

The span adjusters 3.21 and 3.22 are each provided with external threads 3.21C and 3.22C respectively which engage threads in the surface of the enlarged bore portions 3.40C of the main throughbore 3.40.

In order to open the valve to fuel to flow through it to the burner, the valve member 3.23 is rotated until the transverse channels 3.42 in the valve member come into alignment with the windows 3.46 in the obturator elements and the inlet 3.27 and outlet 3.28 of the fuel valve thereby creating a free flow path through the valve. In order to turn off the flow of fuel to the burner, the valve member 3.23 is rotated so that the transverse channels 3.42 are moved out of alignment with the windows 3.46 and the fuel inlet 3.27 and fuel outlet 3.28.

The rate of flow of fuel through the passages 3.42 and 3.46 can be varied by rotating the span adjuster 3.21 so that it rides along the threaded region 3.48 of the valve insert 3.24 thereby causing the obturator element 3.24 to move along the main throughbore towards the midpoint. As the valve insert 3.24 moves, the area of overlap of the channels 3.42 and windows 3.46 is progressively reduced thereby reducing the amount of fuel that can pass through the transverse channels. In general, the area of overlap of the channels 3.42 and windows 3.46, and hence the fuel flow rate through the valve, is set prior to use of the burner according to the size and nature of the burner and the type of fuel that is to be used. Thus, for example, more viscous waste oils may require a larger aperture (i.e. larger area of overlap) whereas lighter gas oils may typically require a smaller aperture. It will be appreciated also that a larger burner will require more fuel and hence the valve will be set so as to give a larger area of overlap between the channels 3.42 and windows 3.46.

The inlet 3.27 and outlet 3.28 passages are linked by a bypass passage 3.26 which forms a secondary flow path through the block. A fuel pressure gauge 3.29 is mounted in a threaded aperture in the wall of the fuel valve block so that the inner end of the fuel gauge is in fluid communication with the bypass channel 3.26. Also disposed in the bypass channel is a bypass needle valve 3.25 which has a passageway 3.25C of reduced diameter extending through part of its length.

A stop bolt 3.30 is mounted in a threaded passageway and this can be tightened to prevent rotational movement of the obturator element 3.24.

The rotatable valve member 3.23 is connected to an electronic actuator device 3.31 which can rotate the valve member to allow the passage of fuel through the valve.

When setting up the burner, the fuel to be used is selected by actuating the appropriate solenoid valve 3.30A or 3.30B with the rotatable valve member 3.23 in the closed position, i.e. wherein the transverse channel 3.42 is not aligned with the transverse channel or window 3.46 through the obturator element 3.24. The fuel is therefore diverted along the bypass channel 3.26 past the fuel pressure gauge 3.29 which senses the fuel pressure being delivered. The bypass needle valve 3.25 is set to the minimum aperture required to produce a flame and fuel passes through the valve 3.25 and on towards the lance where it is atomised and ejected into the turbulent air stream. The gas ignition lance 3.32 is used initially to initiate combustion of the atomised fuel. Once the fuel has been ignited, the rotatable valve member 3.23 can be rotated into an open position to allow fuel to pass directly from inlet 3.27 to the outlet 3.28 and on to the lance 3.16.

In use, atomised fuel ejected from the lance 3.16 is mixed with turbulent air passing through the swirl plate 3.11 and the air twist plate 4.31. Excess air is directed through the gap 3.13.

In order to increase the temperature of the burner, more fuel is delivered to the lance 3.16 through the fuel valve 3.2. At the same time, the airflow rate is increased proportionately in order to keep the fuel to air ratio at the correct level. However, increasing airflow through the combustion chamber would lead to the build-up of back pressure behind the swirl plate as only a proportion of the excess air would be able to escape through the gap 3.13. Therefore, in order to avoid the back pressure build-up, the swirl plate is moved forwardly (i.e. towards the combustion chamber 4) thereby increasing the gap 3.13 and allowing more excess air to pass through the gap. By enabling more air to be delivered to the combustion chamber, the fuel is burnt more efficiently and concentrations of carbon monoxide are substantially reduced.

The efficiency of combustion is further enhanced by the presence of the fixed air twist plate 4.3 which rotates the air in the opposite direction to the swirl plate 3.11, thereby increasing turbulence in the air and ensuring mixing of the air and atomised fuel.

In the burner apparatus of FIGS. 1 to 16, the swirl plate 3.11 is mounted on support rods 3.7 and can be moved backwards and forwards in an axial direction in order to vary the size of the air gap 3.13.

Figure 17A:
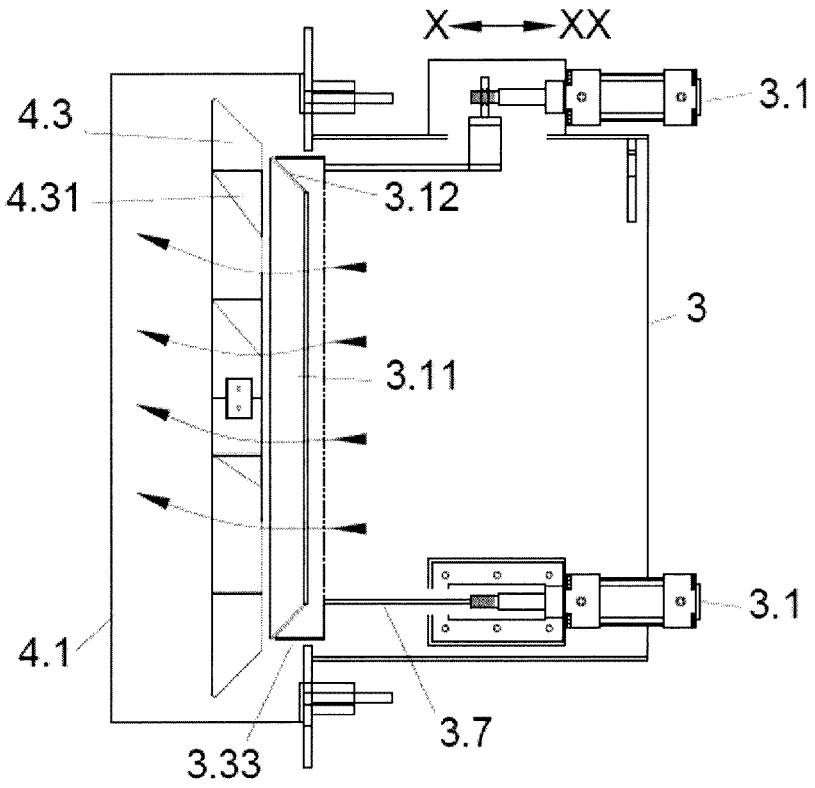
FIG. 17A is sectional view showing the interior of the burner chamber and part of the combustion chamber with a swirl plate in a closed position.
Figure 17B:
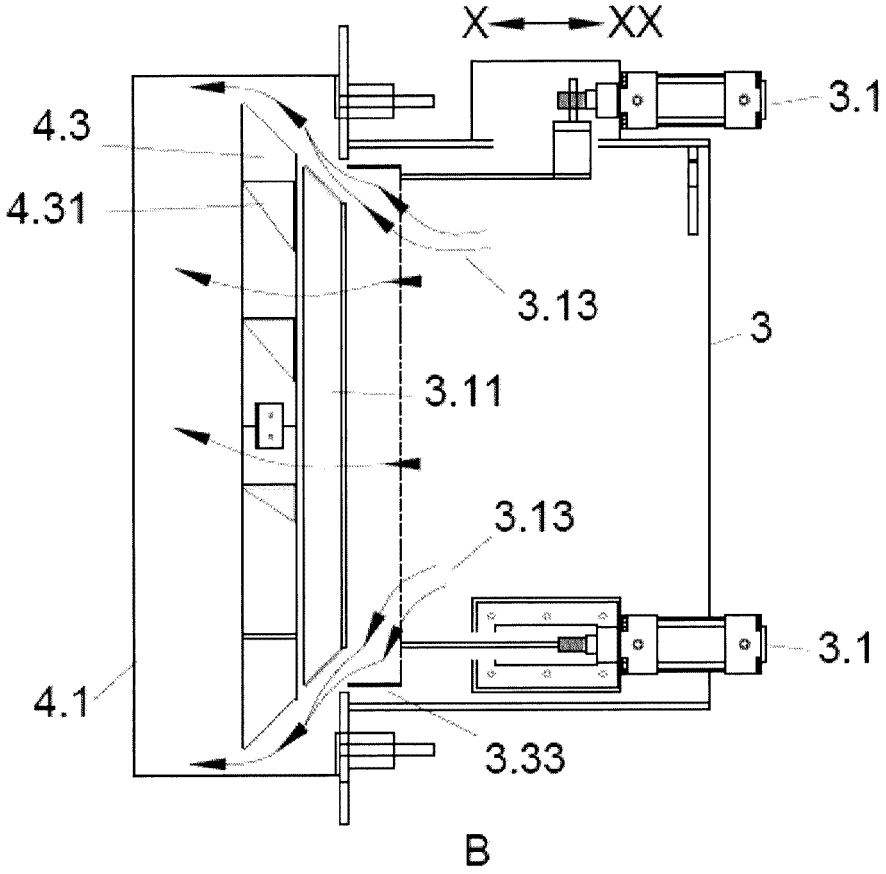
FIG. 17B corresponds to FIG. 17A except that that the swirl plate is shown in an open position.

FIGS. 17A and 17B illustrate an embodiment of the invention which is provided with alternative means of varying the size of the air gap 3.13. Thus, in FIGS. 17A and 17B, a baffle 3.33 is mounted on support rods attached to the pneumatic rams 3.1. In this embodiment, it is the axial movement of the baffle 3.33 along the line X-XX which results in variation of the gap 3.13. The arrangement shown in FIGS. 17A and 17B is particularly suitable for use with natural gas and LPG fuelled burners but can also be used for oil-fired burners.

The burners of the invention have greatly improved efficiency of combustion compared to known fuel oil burners typically used in asphalt manufacturing plants.

The improved combustion efficiency is demonstrated by the greatly reduced carbon monoxide concentrations produced by burners of the present invention compared with known commercially available fuel oil burners used in asphalt plants. For example, when burning 100% recycled fuel oil, carbon monoxide emissions were comparable to those produced by natural gas burners and were less than a third (and in three out of four cases less than a quarter) of the carbon monoxide emissions produced by commercially available fuel oil burners.

EQUIVALENTS

It will readily be apparent that numerous modifications and alterations may be made to the specific embodiments of the invention described above without departing from the principles underlying the invention. All such modifications and alterations are intended to be embraced by this application.

The invention claimed is:

1. A burner configured for use with a dryer for drying aggregates, the burner comprising:

a burner chamber is which is mounted a fuel-atomising burner nozzle and a fuel conveyor which conveys fuel to the burner nozzle;

a combustion chamber in which the fuel is burnt; the combustion chamber having an opening at an upstream end communicating with the burner chamber and an opening at a downstream end thereof for passing combustion gases and heated air into a drying chamber of the dryer; the burner nozzle being arranged to direct a flow of atomised fuel into the combustion chamber;

a fan for providing a flow of air through the burner chamber and into the combustion chamber;

a first airflow modifier device mounted in or across the opening at the upstream end of the combustion chamber such that there is a gap constituting an air escape channel around a periphery of the first airflow modifier device, the first airflow modifier device having one or more windows therein through which the flow of air provided by the fan is directed into the combustion chamber to mix with atomised fuel from the burner nozzle, the one or more windows being configured to impart turbulence to the airflow; and a second airflow modifier device comprising one or more air deflector elements mounted peripherally about the opening at the upstream end of the combustion chamber, the second airflow modifier device being arranged to impart turbulence to excess air passing through the said air escape channel.

2. A burner according to claim 1 wherein the size of the air escape channel around the periphery of the first airflow modifier device is variable so as to vary the flow of excess air into the combustion chamber.

3. A burner according to claim 2 wherein the first airflow modifier device is configured to impart twist to a stream of air passing through it.

4. A burner according to claim 3 wherein the first airflow modifier device takes the form of a swirl plate comprising a plurality of radially extending vanes arranged so as to twist the flow of air into a vortex.

5. A burner according to claim 1 wherein the second airflow modifier device is fixed relative to the opening at the upstream end of the combustion chamber.

6. A burner according to claim 5 wherein the second airflow modifier device is mounted in the combustion chamber on a wall separating the combustion chamber from the burner chamber so that it surrounds the said opening.

7. A burner according to claim 1 wherein the second airflow modifier device comprises a plurality of air twist blades mounted on an inner wall of the combustion chamber in close proximity to the air escape channel around the periphery of the first airflow modifier device.

8. A burner according to claim 7 wherein the air twist blades are angled so as to direct the air into a vortex.

9. A burner according to claim 8 wherein the direction of twist imparted by the second airflow modifier device is opposite to a direction of twist imparted by the first airflow modifier device.

10. A burner according to claim 1 wherein the first airflow modifier device has peripheral surface which is inclined at an angle of from 20° to 70° with respect to the plane of the first airflow modifier device so as to direct excess air outwardly and around the first airflow modifier device and into the combustion chamber.

11. A burner according to claim 10 wherein the gap around the periphery of the first airflow modifier device is defined by the distance between an outer edge of the first airflow modifier device and an inner rim of the upstream opening of the combustion chamber, and the size of the gap is controlled by moving the first airflow modifier device with respect to the inner rim of the said opening.

12. A burner according to claim 11 which is configured such that movement of the first airflow modifier device backwards or forwards in an axial direction results in the size of the gap changing.

13. A burner according to claim 1 wherein the first airflow modifier device is immovable so that the distance between an outer edge of the first airflow modifier device and an inner rim of the upstream opening of the combustion chamber is fixed, and a movable baffle element is provided which can be moved into or out of the gap to vary the size of the gap.

14. A burner according to claim 12 wherein the first airflow modifier device, is mounted on a support frame or support rods which are movable by virtue of being mounted on or linked to an actuator.

15. A burner according to claim 1 wherein the combustion chamber is constructed so as to be adjustable in length.

16. A burner according to claim 15 wherein the combustion chamber is formed from two or more telescopic components which can be moved together to reduce the length of the combustion chamber or moved apart to increase the length of the combustion chamber.

17. A burner according to claim 1 which further comprises an air intake, a fan chamber and a motor for driving the fan which together constitute a blower module.

18. A burner according to claim 17 wherein the blower module is constructed so that it can be separated from the burner chamber to allow access to the burner chamber for maintenance purposes, said blower module being movably mounted on a support structure so that it can be moved away from the burner chamber to give access to the burner chamber.

19. A dryer apparatus comprising a burner as defined in claim 1.

20. A burner configured for use with a dryer for drying aggregates, the burner comprising:

a burner chamber in which is mounted a fuel-atomising burner nozzle and a fuel conveyor which conveys fuel to the burner nozzle;

a fan for providing a flow of air for the burner;

a combustion chamber in which the fuel is burnt; the combustion chamber having an opening at an upstream end communicating with the burner chamber and an opening at a downstream end thereof for passing combustion gases and heated air into a drying chamber of the dryer; the burner nozzle being arranged to direct a flow of atomised fuel into the combustion chamber;

a first airflow modifier device mounted in or across the opening at the upstream end of the combustion chamber such that there is a gap constituting an air escape channel around a periphery of the first airflow modifier device, the first airflow modifier device having one or more windows therein through which a flow of air provided by the fan is directed into the combustion chamber to mix with atomised fuel from the burner nozzle, the one or more windows being configured to impart turbulence to the airflow; and wherein the combustion chamber is constructed so as to be adjustable in length; and optionally wherein:

(i) a second airflow modifier device comprising one or more air deflector elements mounted peripherally about the opening at the upstream end of the combustion chamber, the second airflow modifier device being arranged to impart turbulence to excess air passing through the said air escape channel; and/or (ii) the size of the air escape channel is variable so as to vary the flow of excess air into the combustion chamber.

* * * * *